US010590900B2

(12) United States Patent
Kurt et al.

(10) Patent No.: US 10,590,900 B2
(45) Date of Patent: Mar. 17, 2020

(54) PUMP DEVICE AND FUEL SUPPLY DEVICE FOR AN INTERNAL COMBUSTION ENGINE AND MIXING DEVICE, IN PARTICULAR FOR A MOTOR VEHICLE

(71) Applicant: Continental Automotive GmbH, Hannover (DE)

(72) Inventors: Yavuz Kurt, Roding (DE); Michael Mauer, Regensburg (DE)

(73) Assignee: Vitesco Technologies GmbH, Hannover (DE)

( * ) Notice: Subject to any disclaimer, the term of this patent is extended or adjusted under 35 U.S.C. 154(b) by 24 days.

(21) Appl. No.: 15/945,115

(22) Filed: Apr. 4, 2018

(65) Prior Publication Data

US 2018/0223786 A1 Aug. 9, 2018

Related U.S. Application Data

(63) Continuation of application No. PCT/EP2016/072245, filed on Sep. 20, 2016.

(30) Foreign Application Priority Data

Oct. 7, 2015 (DE) ..... 10 2015 219 419

(51) Int. Cl.
*F02D 41/30* (2006.01)
*F02M 31/20* (2006.01)
(Continued)

(52) U.S. Cl.
CPC ..... *F02M 69/462* (2013.01); *F02D 41/3094* (2013.01); *F02D 41/3854* (2013.01);
(Continued)

(58) Field of Classification Search
CPC ..... F02D 41/3094; F02D 41/3854; F02D 2041/3881; F02M 31/20; F02M 37/043; F02M 53/00; F02M 53/043; F02M 63/029
(Continued)

(56) References Cited

U.S. PATENT DOCUMENTS 6,446,612 B1 9/2002 Hankins et al.
6,739,317 B2 5/2004 Kellner et al.
(Continued)

FOREIGN PATENT DOCUMENTS

DE 19647049 A1 5/1998
DE 102010026159 A1 1/2012
(Continued)

OTHER PUBLICATIONS

International Search Report and Written Opinion dated Dec. 8, 2016 from corresponding International Patent Application No. PCT/EP2016/072245.
(Continued)

*Primary Examiner* — Erick R Solis

(57) ABSTRACT

A pump device for an internal combustion engine, having a high-pressure fuel pump for supplying fuel to a first injection device, having at least one low-pressure inlet, via which the fuel is fed to the high-pressure fuel pump from a low-pressure fuel pump, having at least one low-pressure outlet for conducting the fuel conveyed by the low-pressure fuel pump and fed via the low-pressure inlet to the high-pressure fuel pump out of the high-pressure fuel pump, and having at least one low-pressure port, for conducting fuel conveyed by the low-pressure fuel pump to a second injection device. At least one mixing region mixes the fuel flowing through the low-pressure outlet with fuel fed to the mixing region from the low-pressure fuel pump upstream of
(Continued)

the high-pressure fuel pump. The low-pressure port is fluidically connected to the mixing region, and the low-pressure inlet is supplied with fuel from the mixing region.

17 Claims, 7 Drawing Sheets

(51) Int. Cl.

| | |
|---|---|
| ***F02M 53/00*** | (2006.01) |
| ***F02M 69/46*** | (2006.01) |
| ***F02M 63/02*** | (2006.01) |
| ***F02D 41/38*** | (2006.01) |
| ***F02M 55/02*** | (2006.01) |
| ***F02M 63/00*** | (2006.01) |
| ***F02M 37/04*** | (2006.01) |
| ***F02M 53/04*** | (2006.01) |
| ***F02M 59/16*** | (2006.01) |
| ***F02M 69/02*** | (2006.01) |

(52) U.S. Cl.
CPC ..... *F02M 37/043* (2013.01); *F02M 53/00* (2013.01); *F02M 53/043* (2013.01); *F02M 55/02* (2013.01); *F02M 59/16* (2013.01); *F02M 63/0001* (2013.01); *F02M 63/029* (2013.01); *F02M 69/02* (2013.01); *F02D 2041/3881* (2013.01); *F02M 2200/315* (2013.01)

(58) Field of Classification Search
USPC ..... 123/431, 495, 508, 541
See application file for complete search history.

(56) References Cited

U.S. PATENT DOCUMENTS

| | | | | |
|---|---|---|---|---|
| 7,380,541 | B1 * | 6/2008 | Ricco | F02M 37/00 123/447 |
| 2002/0134360 | A1 * | 9/2002 | Hankins | F02D 33/006 123/514 |
| 2005/0098155 | A1 | 5/2005 | Yamazaki et al. | |
| 2006/0075992 | A1 | 4/2006 | Akita et al. | |
| 2006/0159555 | A1 | 7/2006 | Inoue | |
| 2008/0115766 | A1 | 5/2008 | Ricco et al. | |
| 2008/0289713 | A1 | 11/2008 | Munakata et al. | |
| 2009/0288639 | A1 | 11/2009 | Usui et al. | |
| 2010/0101538 | A1 | 4/2010 | Beardmore | |
| 2011/0097228 | A1 | 4/2011 | Tokuo et al. | |
| 2012/0279474 | A1 | 11/2012 | Hoefner | |
| 2012/0312278 | A1 | 12/2012 | Usui et al. | |
| 2013/0098338 | A1 | 4/2013 | Usui et al. | |
| 2013/0118449 | A1 | 5/2013 | Marriott et al. | |
| 2014/0216418 | A1 | 8/2014 | Asayama | |
| 2014/0224209 | A1 | 8/2014 | Pursifull et al. | |
| 2014/0224217 | A1 | 8/2014 | Pursifull et al. | |
| 2015/0132166 | A1 | 5/2015 | Ukai et al. | |
| 2015/0285166 | A1 | 10/2015 | Sumilla et al. | |
| 2015/0337753 | A1 | 11/2015 | Stickler et al. | |
| 2015/0354491 | A1 | 12/2015 | Ulrey et al. | |
| 2016/0131097 | A1 | 5/2016 | Matsuo et al. | |
| 2016/0153385 | A1 | 6/2016 | Pursifull | |
| 2016/0169144 | A1 | 6/2016 | Surnilla et al. | |
| 2016/0169145 | A1 | 6/2016 | Sumilla et al. | |
| 2016/0208757 | A1 | 7/2016 | Pursifull et al. | |
| 2016/0208758 | A1 * | 7/2016 | Nigrin | F02M 53/00 |
| 2016/0245218 | A1 | 8/2016 | Ulrey et al. | |
| 2016/0363104 | A1 | 12/2016 | Sanborn et al. | |
| 2016/0377015 | A1 | 12/2016 | Pursifull | |
| 2016/0377016 | A1 | 12/2016 | Ulrey et al. | |
| 2016/0377017 | A1 | 12/2016 | Ulrey et al. | |
| 2016/0377018 | A1 | 12/2016 | Sanborn et al. | |
| 2017/0167450 | A1 * | 6/2017 | Spakowski | F02M 31/20 |
| 2017/0204803 | A1 | 7/2017 | Pursifull et al. | |
| 2017/0284353 | A1 | 10/2017 | Nozu et al. | |
| 2017/0292485 | A1 | 10/2017 | Nah et al. | |
| 2017/0306880 | A1 | 10/2017 | Nakaoka | |
| 2018/0283336 | A1 | 10/2018 | Kurt et al. | |
| 2018/0298858 | A1 | 10/2018 | Kurt | |

FOREIGN PATENT DOCUMENTS

| | | | |
|---|---|---|---|
| EP | 1550805 | A1 | 7/2005 |
| EP | 2591225 | A1 | 5/2013 |
| JP | H0687662 | A | 12/1994 |
| JP | 2004340208 | A | 12/2004 |
| JP | 2009007986 | A | 1/2009 |
| JP | 2012026358 | A | 2/2012 |
| JP | 2012063111 | A | 3/2012 |
| JP | 2012122437 | A | 6/2012 |
| JP | 5401360 | B2 | 1/2014 |
| JP | 2015098849 | A | 5/2015 |
| WO | 2012004084 | A1 | 1/2012 |
| WO | 2013035131 | A1 | 3/2013 |

OTHER PUBLICATIONS

Office Action dated Sep. 9, 2016 from corresponding German Patent Application No. 10 2015 219 419.1.
Notice of Allowance dated Mar. 25, 2019 for corresponding Japanese patent application No. 2018-517744.
File History for U.S. Appl. No. 15/766,403, including Office Action dated Jun. 26, 2019.
File History for U.S. Appl. No. 15/766,186, including Office Action dated Jun. 7, 2019.
Written Opinion, dated Aug. 7, 2019 for counterpart KR patent application 10-2018-7012971.

* cited by examiner

PUMP DEVICE AND FUEL SUPPLY DEVICE FOR AN INTERNAL COMBUSTION ENGINE AND MIXING DEVICE, IN PARTICULAR FOR A MOTOR VEHICLE

CROSS-REFERENCE TO RELATED APPLICATIONS

This application claims the benefit of PCT Application PCT/EP2016/072245, filed Sep. 20, 2016, which claims priority to German Patent Application 10 2015 219 419.1, filed Oct. 7, 2015. The disclosures of the above applications are incorporated herein by reference.

FIELD OF THE INVENTION

The invention relates to a pump device, a fuel supply device, and a mixing device, in particular for a motor vehicle.

BACKGROUND OF THE INVENTION

A pump device, and a fuel supply device for an internal combustion engine, in particular of a motor vehicle, already emerge, so as to be known, for example from US 2012/0312278 A1. The fuel supply device serves for supplying fuel, in particular liquid fuel, to the internal combustion engine. The fuel supply device comprises a first injection device for effecting a direct injection of fuel. This means that the internal combustion engine has at least one combustion chamber into which the fuel is directly injected by means of the first injection device.

The fuel supply device furthermore comprises a second injection device, which is provided in addition to the first injection device, for effecting an induction pipe injection of fuel. During the course of the intake pipe injection of fuel, which is also referred to as intake pipe injection, the fuel is introduced, in particular injected, into the internal combustion engine at a location arranged upstream of the combustion chamber. The location is arranged for example in an intake pipe, through which air may flow, of the internal combustion engine, and upstream of an inlet valve of the internal combustion engine.

The fuel supply device furthermore comprises the above-mentioned high-pressure fuel pump, by means of which the fuel is supplied to the first injection device. This means that the fuel is conveyed to the first injection device by means of the high-pressure fuel pump. The fuel supply device furthermore comprises a low-pressure fuel pump for conveying the fuel to the high-pressure fuel pump. By means of the low-pressure fuel pump, the fuel is conveyed for example at a first pressure. In other words, by means of the low-pressure fuel pump, a first pressure of the fuel that is conveyed by means of the low-pressure fuel pump is effected.

By means of the high-pressure fuel pump, the fuel is conveyed for example at a second pressure that is higher than the first pressure. In other words, by means of the high-pressure fuel pump, a second pressure of the fuel that is higher than the first pressure is effected. In this way, it is for example possible for the first injection device to be supplied with the second pressure that is higher than the first pressure, where the second injection device is supplied with the first pressure.

The high-pressure fuel pump has at least one low-pressure inlet via which fuel is fed to the high-pressure fuel pump from the low-pressure fuel pump. This means that at least a part of the fuel conveyed by means of the low-pressure fuel pump is fed via the low-pressure inlet to the high-pressure fuel pump.

The high-pressure fuel pump furthermore has at least one low-pressure outlet for conducting fuel conveyed by means of the low-pressure fuel pump and fed via the low-pressure inlet to the high-pressure fuel pump out of the high-pressure fuel pump. This means that at least a part of the fuel that flows via the low-pressure inlet into the high-pressure fuel pump may flow out of or away from the high-pressure fuel pump via the low-pressure outlet, where, for example, the fuel flowing through the low-pressure outlet is at the first pressure effected by means of the low-pressure fuel pump. Thus, for example, the fuel flowing through the low-pressure outlet is not compressed by means of the high-pressure fuel pump.

Furthermore, the device comprises at least one low-pressure port for conducting fuel conveyed by means of the low-pressure fuel pump to the second injection device which is provided in addition to the first injection device. This means that the fuel that is for example at the first pressure is conducted by means of the low-pressure port to the second injection device, such that the second injection device is supplied via the low-pressure port with fuel that is in particular at the first pressure.

Furthermore, WO 2012/004084 A1 discloses a fuel system for an internal combustion engine, having a low-pressure conveying device which conveys at least indirectly to at least one low-pressure injection device. The fuel system furthermore comprises a high-pressure conveying device for the fuel, which high-pressure conveying device has a drive region and a conveying region and conveys at least indirectly to at least one high-pressure injection device. It is provided here that the fuel is conveyed from the low-pressure conveying device firstly into the drive region of the high-pressure conveying device and from there onward to the low-pressure injection device and/or to the conveying region of the high-pressure conveying device.

SUMMARY OF THE INVENTION

It is an object of the present invention to provide a pump device, a fuel supply device and a mixing device, by means of which a particularly advantageous fluid supply may be realized.

The object is achieved by means of a pump device having the features of patent claim 1, by means of a fuel supply device having the features of patent claim 12 and by means of a mixing device having the features of patent claim 13. Advantageous embodiments with expedient refinements of the invention are specified in the further claims.

According to the invention, to further develop a pump device of the type specified in the preamble of patent claim 1 such that it is possible to realize a particularly advantageous fluid supply, in particular a particularly advantageous supply of the fuel, which constitutes a fluid, to the internal combustion engine, at least one mixing region is provided for mixing the fuel flowing through the low-pressure outlet with fuel fed to the mixing region from the low-pressure fuel pump upstream of the low-pressure inlet, and thus upstream of the high-pressure fuel pump. Here, the low-pressure port is fluidically connected to the mixing region, and the low-pressure inlet is supplied with fuel from the mixing region.

The mixing region is thus fluidically connected to the low-pressure inlet and to the low-pressure outlet, such that at least a part of the fuel flowing through the low-pressure outlet is or may be fed to the mixing region. In addition to this fuel, fuel is fed to the mixing region from the low-pressure fuel upstream of the low-pressure inlet, that is to say at a location upstream of the high-pressure fuel pump, which fuel has therefore not flowed through the high-pressure fuel pump, that is to say through the low-pressure inlet or the low-pressure outlet. The additional fuel which is fed to the mixing region upstream of the high-pressure fuel pump, and which thus differs from the fuel flowing through the low-pressure outlet, is also referred to as fresh fuel, because the fresh fuel has not yet flowed through the high-pressure fuel pump.

The fresh fuel is thus fed to the mixing region upstream of the high-pressure fuel pump or is fed to the mixing region upstream of the high-pressure fuel pump, where the fuel flowing through the low-pressure outlet may be fed or is fed to the mixing region downstream of the low-pressure outlet and thus downstream of the high-pressure pump. In the mixing region, the fresh fuel may mix with the fuel from the low-pressure outlet, where it may be provided that fuel from the mixing region, and thus a part of the mixed fuel, is fed to the low-pressure port. Since the fuel flowing through the low-pressure outlet, which differs from the fresh fuel, flows through the high-pressure pump, the high-pressure fuel pump may hereby be cooled, such that the fuel flowing through the low-pressure outlet is at a first temperature.

The fresh fuel, which is fed to the mixing region from the low-pressure fuel pump upstream of the low-pressure outlet, is at a second temperature which is lower than the first temperature, because the fresh fuel has not yet flowed through the high-pressure fuel pump. As a result of the mixing of the fuel flowing through the low-pressure outlet with the fresh fuel, the temperature of the fuel overall may be kept particularly low. As a result, the internal combustion engine is supplied with fuel which is at a particularly advantageous low temperature. In particular, by means of the mixing of the fuel flowing through the low-pressure outlet with the fresh fuel and by means of the possibly provided supply of fuel from the mixing region to the low-pressure port, a particularly advantageous dissipation of temperature or heat is realized, such that the high-pressure fuel pump is cooled in a particularly effective manner. In this way, overheating and resulting damage and failures of the high-pressure fuel pump is avoided, such that a reliable and thus advantageous supply of the fuel, which constitutes a fluid, to the internal combustion engine may be realized.

In an advantageous refinement of the invention, the low-pressure port is supplied with fuel from the mixing region. In this way, a particularly advantageous dissipation of heat is realized, such that the high-pressure fuel pump is cooled in a particularly effective manner. As a result, a reliable and advantageous supply of the fuel to the internal combustion engine may be realized.

It has proven to be particularly advantageous if the high-pressure fuel pump has a conveying element for conveying the fuel to the first injection device. For example, the high-pressure fuel pump comprises a pump housing, in which the conveying element is at least partially, in particular at least predominantly, accommodated. Here, the conveying element is movable, in particular movable in translational fashion, relative to the pump housing.

The high-pressure fuel pump furthermore has a compression chamber, the volume of which is variable by movement of the conveying element. The compression chamber is for example arranged in the pump housing. Furthermore, the high-pressure fuel pump comprises a collecting chamber which is arranged on a side of the conveying element averted from the compression chamber and which is variable in terms of its volume by movement of the conveying element and which serves for collecting fuel from the compression chamber. The collecting chamber is preferably arranged in the pump housing. Here, at least a part of the fuel flowing through the low-pressure inlet flows from the low-pressure inlet to the collecting chamber, circumventing the compression chamber. The fuel flows through the collecting chamber and then flows through the low-pressure outlet and into the mixing region. "Circumventing" is to be understood to mean that the fuel does not flow through the compression chamber, and is accordingly not compressed and conveyed by means of the conveying element. In this way, heat is discharged from the collecting chamber in an effective manner, such that the high-pressure fuel pump is cooled in an effective manner.

A further embodiment is distinguished by the fact that the mixing region has at least one first feed opening, by means of which the mixing region is fluidically connected to the low-pressure outlet and is supplied with the fuel flowing through the low-pressure outlet. Furthermore, the mixing region has at least one second feed opening, by means of which the mixing region is supplied with fuel from the low-pressure fuel pump, that is to say with the fresh fuel, upstream of the low-pressure inlet and thus upstream of the high-pressure fuel pump. The fresh fuel passing from or conveyed by the low-pressure fuel pump may flow through the second feed opening and flow via the second feed opening into the mixing region, such that the fresh fuel has not yet flowed through the low-pressure inlet and the low-pressure outlet or the high-pressure fuel pump.

Furthermore, the mixing region has at least one first discharge opening, via which fuel is fed from the mixing region to the low-pressure inlet. This means that at least a part of the fuel flowing through the low-pressure inlet is fed to the low-pressure inlet from the mixing region, where the mixing region is fluidically connected via the first discharge opening to the low-pressure inlet. The mixing region furthermore has at least one second discharge opening, via which the low-pressure port is fluidically connected to the mixing region, such that, for example, fuel is fed from the mixing region to the low-pressure port via the second discharge opening.

It is provided here that the feed openings and the discharge openings are respective openings which are spaced apart from one another, such that the mixing region has at least four openings. The first feed opening is in this case for example a first of the openings, the second feed opening is a second of the openings, the first discharge opening is a third of the openings, and the second discharge openings is the fourth opening. Here, the second opening is provided in addition to the first opening, where the third opening is provided in addition to the first opening and in addition to the second opening. Furthermore, the fourth opening is provided in addition to the first opening, in addition to the second opening and in addition to the third opening. Here, fuel may flow through the openings. By means of this design of the mixing region, the mixing region is supplied with the fuel in a particularly advantageous manner and in accordance with demand, where, furthermore, advantageous thorough mixing of the fuel in the mixing region may be realized. As a result, an advantageous dissipation of heat may be realized, such that the high-pressure fuel pump is cooled in an effective manner. It is thus possible to realize an advantageous supply of fuel to the internal combustion engine.

A further embodiment is distinguished by the fact that the second discharge opening is arranged upstream of the first feed opening in relation to a flow direction of the fuel from the second feed opening to the first discharge opening. Firstly, in this way, particularly advantageous cooling of the high-pressure fuel pump may be realized. Secondly, the low-pressure port and thus the second injection device is supplied with fuel in a particularly advantageous manner, because, for example, the temperature of the fuel fed to the second injection device via the low-pressure port is kept low.

To realize a particularly advantageous cooling of the high-pressure fuel pump and therefore to realize a particularly advantageous supply of the fuel to the internal combustion engine, it is provided in a further embodiment of the invention that the second discharge opening is arranged upstream of the first discharge opening, downstream of the second feed opening and downstream of the first feed opening in relation to a flow direction of the fuel from the second feed opening to the first discharge opening.

Here, it has proven to be particularly advantageous if the first feed opening is arranged upstream of the second discharge opening and upstream of the second feed opening in relation to the flow direction of the fuel from the second feed opening to the first discharge opening.

In one particularly advantageous embodiment of the invention, at least one of the feed openings and/or at least one of the discharge openings opens into a duct through which the fuel may flow. In other words, at least one of the stated openings opens into a duct through which the fuel may flow. Here, a valve element, in particular a check valve, is arranged in the duct. By means of the valve element, a flow of the fuel through the duct is influenced or stopped, such that, for example, undesired flows of the fuel is prevented by means of the valve element, in particular the check valve. For example, undesired flows of the fuel via the discharge openings into the mixing region, and undesired flows of the fuel out of the mixing region via the feed openings, is prevented, such that advantageous thorough mixing of the fuel may be realized, and a reliable supply of the fuel to the internal combustion engine may be ensured.

To be able to thoroughly mix the fuel in the mixing region in an advantageous and effective manner, it is provided in one advantageous embodiment of the invention that the mixing region is at least partially, in particular at least predominantly, of spherical form on the inner circumference. It is alternatively or additionally conceivable for the mixing region to have, at least in a partial region, a parallelogram-shaped or rectangular cross section.

If, for example, the low-pressure port is supplied with fuel from the mixing region, then it is preferably provided that the low-pressure port is designed to conduct at least a part of the fuel conveyed by means of the low-pressure fuel pump, which fuel is fed to the high-pressure fuel pump and flows through the low-pressure outlet, away from the high-pressure fuel pump to the second injection device. In this way, it is for example possible for the fuel conveyed by means of the low-pressure fuel pump, or at least a part of the fuel conveyed by means of the low-pressure fuel pump, to flow firstly through the mixing region, then subsequently through the low-pressure inlet, then subsequently through the low-pressure outlet, then subsequently through the mixing region again and then subsequently through the low-pressure port and to then flow to the second injection device, in particular while an injection of fuel effected by means of the first injection device is omitted and, if appropriate, an injection of fuel effected by means of the second injection device is performed. In this way, the high-pressure fuel pump is cooled by means of the fuel conveyed by the low-pressure fuel pump, even when the second injection device is activated, that is to say when fuel is injected by means of the second injection device and the first injection device is deactivated, that is to say an injection of fuel effected by means of the first injection device is omitted. In this way, overheating and resulting damage of the high-pressure fuel pump is reliably avoided.

According to the invention, to further develop a fuel supply device of the type specified in the preamble of patent claim 12 such that it is possible to realize a particularly advantageous fluid supply, in particular a particularly advantageous supply of the fuel, which constitutes a fluid, to the internal combustion engine, at least one mixing region is provided for mixing the fuel flowing through the low-pressure outlet with fuel (fresh fuel) fed to the mixing region from the low-pressure fuel pump upstream of the high-pressure fuel pump, where the low-pressure port is fluidically connected to the mixing region, and the low-pressure inlet is supplied with fuel from the mixing region. Advantages and advantageous embodiments of the high-pressure fuel pump according to the invention are to be regarded as advantages and advantageous embodiments of the fuel supply device according to the invention, and vice versa.

It is preferably provided here that the pump device of the fuel supply device according to the invention is a pump device according to the invention.

The invention also includes a mixing device, in particular for a motor vehicle, in particular a passenger motor vehicle. The mixing device has at least one mixing region for mixing at least one first fluid flow with at least one second fluid flow. The respective fluid flow is formed for example by at least one fluid, where the fluid may be a gas or preferably a liquid. The fluid is preferably an operating medium, in particular an operating liquid, of an internal combustion engine for driving a motor vehicle, where the fluid may be the fuel, in particular liquid fuel, mentioned in conjunction with the pump device according to the invention and the fuel supply device according to the invention.

The mixing region has at least one first inlet, at least one second inlet, at least one first outlet and at least one second outlet. The first inlet is for example the first feed opening mentioned above, where the second inlet is for example the abovementioned second feed opening. The first outlet is for example the first discharge opening mentioned above, where the second outlet is for example the abovementioned second discharge opening. The first fluid flow is fed to the mixing region via the first inlet. The second fluid flow is fed to the mixing region via the second inlet. Fluid is discharged from the mixing region via the first outlet, where fluid is discharged from the mixing region via the second outlet. For example, the fluid flows differ from one another in terms of at least one characteristic. The characteristic is for example a temperature of the respective fluid flow. It may be provided here that one of the fluid flows is warmer than the other fluid flow. It is preferably provided that the second fluid flow is colder than the first fluid flow.

In the case of the mixing device according to the invention, the second outlet is arranged upstream of the first inlet in relation to a flow direction of the fluid from the second inlet to the first outlet. The inlets and outlets are thus arranged in a particularly expedient manner in terms of flow, such that advantageous thorough mixing of the fluid flows may be realized. In particular, by means of the mixing device according to the invention, an advantageous dissipation of heat may be realized, such that, for example, a component, in particular the high-pressure fuel pump described above, is easily cooled in an effective manner.

Refinements of the mixing region of the pump device according to the invention or of the fuel supply device according to the invention mentioned with regard to the pump device according to the invention and the fuel supply device according to the invention are to be regarded as advantageous refinements of the mixing region of the mixing device according to the invention, and vice versa.

It has proven to be particularly advantageous if the mixing region has a rectangular, parallelogram-shaped and/or arcuate, in particular circular, cross section in at least one subregion on the inner circumference.

The invention also includes a vehicle, in particular a motor vehicle such as for example a passenger motor vehicle, having at least one high-pressure fuel pump according to the invention and/or having at least one fuel supply device according to the invention and/or having at least one mixing device according to the invention.

Further advantages, features and details of the invention will emerge from the following description of preferred exemplary embodiments and from the drawing. The features and combinations of features mentioned in the description above and the features and combinations of features mentioned in the description of the figures below and/or shown in the figures alone may be used not only in the respectively stated combination, but also in other combinations or alone without departing from the scope of the invention.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Exemplary embodiments of the invention will be explained in more detail hereunder by means of the schematic drawings. In the figures.

In the figures, identical or functionally identical elements are provided with identical reference signs.

DETAILED DESCRIPTION OF THE PREFERRED EMBODIMENT

The following description of the preferred embodiment(s) is merely exemplary in nature and is in no way intended to limit the invention, its application, or uses.

Figure 1:
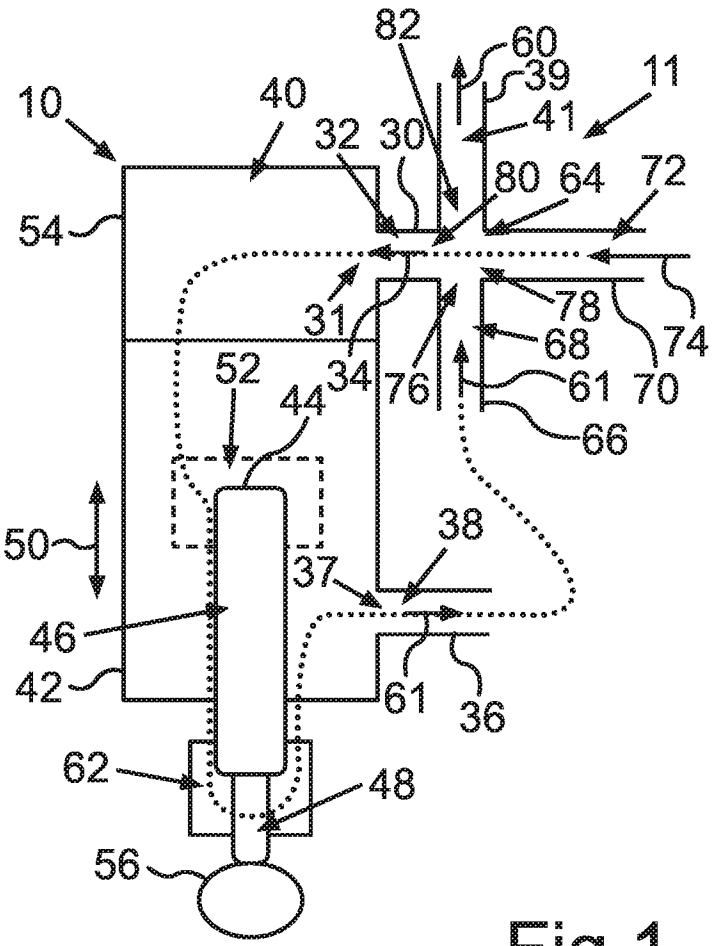
FIG. 1 shows a schematic sectional view of a pump device according to a first embodiment for supplying fuel to a first injection device of an internal combustion engine, in particular of a motor vehicle, where the pump device has at least one mixing region for mixing fuel.

FIG. 1 shows, in a schematic sectional view, a pump device according to a first embodiment, which is denoted is a whole by 11. The pump device 11 comprises a high-pressure fuel pump 10. Considering the figure together with FIG. 7, it is seen that the pump device 11 and thus the high-pressure fuel pump 10 are constituent parts of a fuel supply device denoted as a whole by 12, by means of which fuel, in particular liquid fuel, may be or is supplied to an internal combustion engine. The fuel may for example be diesel fuel or gasoline. The internal combustion engine serves for example for the drive of a motor vehicle, in particular of a passenger motor vehicle, where the internal combustion engine may be formed as a reciprocating-piston internal combustion engine.

The internal combustion engine has a multiplicity of combustion chambers in the form of cylinders, where the fuel is fed to the combustion chambers. Furthermore, air is fed to the combustion chambers, such that a fuel-air mixture is formed in the respective combustion chamber from the air and the fuel. The fuel-air mixture is burned, resulting in exhaust gas of the internal combustion engine.

The respective combustion chamber is assigned at least one outlet duct via which the exhaust gas is discharged from the combustion chamber. The outlet duct is assigned at least one gas exchange valve in the form of an outlet valve, where the outlet valve is movable between a closed position and at least one open position. In the closed position, the outlet duct is fluidically shut off by means of the outlet valve, such that the exhaust gas may not flow from the combustion chamber into the outlet duct. In the open position, the outlet valve opens up the outlet duct, such that the exhaust gas may flow from the combustion chamber into the outlet duct.

Furthermore, the respective combustion chamber is assigned at least one inlet duct, via which the air is fed to the combustion chamber. Here, the inlet duct is assigned at least one gas exchange valve in the form of an inlet valve, which is adjustable between a closed position and at least one open position. In the closed position, the inlet duct is fluidically shut off by means of the inlet valve, such that the air cannot flow from the inlet duct into the combustion chamber. In the open position, the inlet valve opens up the inlet duct, such that the air may flow through the inlet duct and may flow from the inlet duct into the combustion chamber.

The fuel supply device 12 comprises a first injection device 14, which is formed for example as a high-pressure injection device. Here, each combustion chamber is assigned an injection valve 16 of the first injection device 14. The first injection device 14 is in this case designed for effecting a direct injection of fuel, where the direct injection of fuel is also referred to as direct injection. During the course of the direct injection, the fuel is injected by means of the respective injection valve 16 directly into the respective combustion chamber, in particular cylinder. Here, the first injection device 14 comprises a fuel distribution element 18 which is common to the injection valves 16 and via which the fuel is supplied to the injection valves 16. The fuel distribution element 18 is also referred to as a rail, where the fuel distribution element 18 is referred to as a high-pressure rail if the first injection device 14 is formed as a high-pressure injection means. By means of the first injection device 14, the fuel is injected for example at a first pressure into the combustion chambers, where, for example, the fuel at the first pressure is accommodated in the fuel distribution element 18 and fed at the first pressure to the injection valves 16.

The fuel supply device 12 furthermore comprises a second injection device 20 which is provided in addition to the first injection device 14 and which is formed for example as a low-pressure injection device. The second injection device 20 is in this case designed for effecting an induction pipe injection of fuel, where the induction pipe injection of fuel is also referred to as induction pipe injection. Here, each combustion chamber is assigned at least one injection valve 22 of the second injection device 20.

The air is fed to the combustion chambers for example via an intake tract of the internal combustion engine, such that the intake tract may be flowed through by the air. The intake tract comprises for example an induction pipe, which is also referred to as induction module, intake module or air distributor. The intake tract may furthermore comprise the inlet ducts.

In the case of the induction pipe injection, the fuel is introduced, in particular injected, into the internal combustion engine, in particular into the intake tract, by means of the respective injection valve 22 at a location arranged upstream of the respective combustion chamber. In other words, the location at which the fuel is injected by means of the respective injection valve 22 is arranged upstream of the combustion chamber and in particular in the intake tract. The location may be arranged for example in the induction pipe or in the inlet duct. In particular, the respective location at which the fuel is injected by means of the respective injection valve 22 is arranged upstream of the respective inlet valve.

The second injection device 20 also comprises a fuel distribution element 24 which is common to the injection valves 22 and via which the fuel is supplied to the injection valves 22. Here, the fuel distribution element 24 is also referred to as rail. Since the second injection device 20 is formed for example as a low-pressure injection device, the fuel distribution element 24 is also referred to as low-pressure rail. By means of the second injection device 20, the fuel is injected for example at a second pressure that is lower than the first pressure. Here, the fuel at the second pressure may for example be accommodated or stored in the fuel distribution element 24 and fed at the second pressure to the injection valves 22. The fuel supply device 12 furthermore comprises a tank 26 in which the in particular liquid fuel is accommodated.

Figure 7:
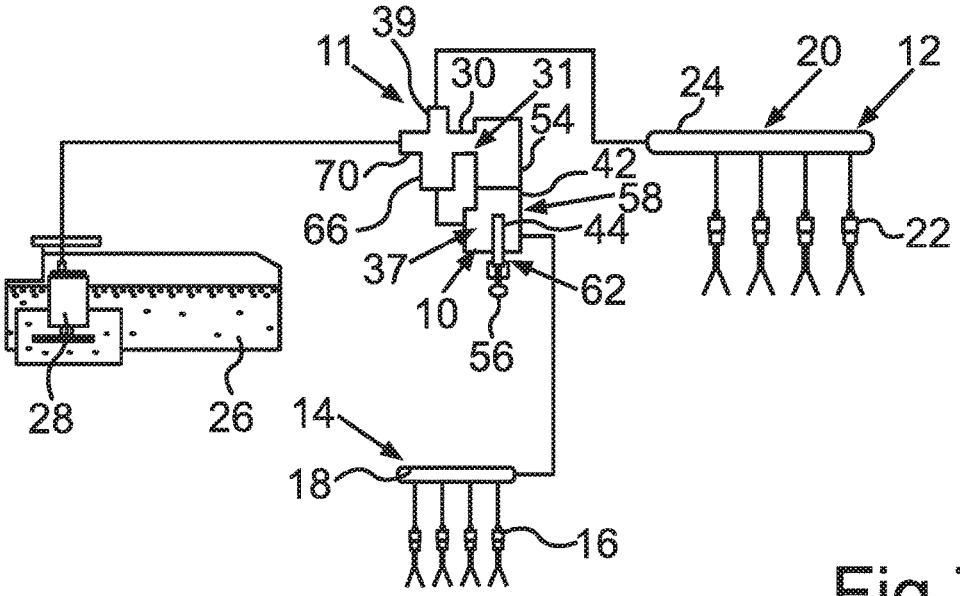
FIG. 7 is a schematic illustration of a fuel supply device for an internal combustion engine, where the fuel supply device comprises the pump device.

It is seen from FIG. 7 that the high-pressure fuel pump 10 serves for the supply of the fuel to the first injection device 14. In other words, the fuel is supplied to the first injection device 14 by means of the high-pressure fuel pump 10, where the fuel is compressed or pressurized for example by means of the high-pressure fuel pump 10 such that the stated first pressure of the fuel may be or is effected for example by means of the high-pressure fuel pump 10. In other words, the fuel is conveyed at the first pressure to the first injection device 14 by means of the high-pressure fuel pump 10.

The fuel supply device 12 furthermore comprises a low-pressure fuel pump 28 which is provided in addition to the high-pressure fuel pump 10 and which serves for conveying the fuel from the tank 26 to the high-pressure fuel pump 10. This means that the fuel is conveyed from the tank 26 to the high-pressure fuel pump 10 by means of the low-pressure fuel pump 28. For example, the fuel is conveyed at a third pressure by means of the low-pressure fuel pump 28. This means that a third pressure of the fuel is effected for example by means of the low-pressure fuel pump 28, where the fuel is conveyed at the third pressure to the high-pressure fuel pump 10 by means of the low-pressure fuel pump 28. Here, the third pressure may correspond to the second pressure, such that, for example, the second pressure of the fuel is effected by means of the low-pressure fuel pump 28. In other words, the low-pressure fuel pump 28 may for example convey the fuel at the second pressure, which may correspond to the third pressure.

It is seen from FIGS. 1 and 7 that the high-pressure fuel pump 10 has a first low-pressure port 30 which comprises a first duct 32 which may be flowed through by the fuel. Furthermore, the high-pressure fuel pump 10 has a low-pressure inlet 31 which is formed by the first low-pressure port 30 and which, in the present case, is formed as an inlet opening or inflow opening. Via the low-pressure inlet 31 or the first low-pressure port 30, the high-pressure fuel pump 10 is fluidically connected to the low-pressure fuel pump 28, such that at least a part of the fuel conveyed by means of the low-pressure fuel pump 28 may be fed or is fed, in particular at the second or third pressure, from the low-pressure fuel pump 28 to the high-pressure fuel pump 10 via the first low-pressure port 30 or the low-pressure inlet 31. This feed is illustrated in FIG. 1 by means of a directional arrow 34. The directional arrow 34 thus illustrates a flow direction along which the fuel at the second or third pressure flows through the duct 32 and the low-pressure inlet 31 and thus flows into the high-pressure fuel pump 10.

Since the fuel is fed to the high-pressure fuel pump 10, and in particular introduced into the high-pressure fuel pump 10, via the first low-pressure port 30 and in this case via the first duct 32 and the low-pressure inlet 31, the first low-pressure port 30 is also referred to as inflow. It is seen from FIG. 1 that the high-pressure fuel pump 10 is a constituent part of the pump device denoted as a whole by 11, the features and functions of which will be discussed in more detail below.

The high-pressure fuel pump 10 and thus the pump device 11 furthermore comprise at least one second low-pressure port 36, which has a duct 38 which may be flowed through by fuel. The second low-pressure port 36 forms a low-pressure outlet 37 of the high-pressure fuel pump 10, where the low-pressure outlet 37 is designed for conducting fuel conveyed by means of the low-pressure fuel pump 28 and fed via the low-pressure inlet 31 to the high-pressure fuel pump 10 out of the high-pressure fuel pump 10. This means that at least a part of the fuel that has flowed into the high-pressure fuel pump 10 via the low-pressure inlet 31 may, via the low-pressure outlet 37, be discharged from the high-pressure fuel pump 10 or conducted out of or discharged from the high-pressure fuel pump 10.

As already discussed, the fuel flowing through the duct 32 and thus through the low-pressure inlet 31 is at the second or third pressure, because it is conveyed by means of the low-pressure fuel pump 28. The fuel flowing through the low-pressure outlet 37 and thus through the duct 38 is at least substantially at the second or third pressure, because the fuel flowing through the low-pressure outlet 37 and thus through the duct 38 is not compressed, that is to say is not pressurized, by means of the high-pressure fuel pump 10. This means that a compression or pressurization, effected by the high-pressure fuel pump 10, of the fuel flowing through the low-pressure outlet 37 is omitted, such that the fuel flowing through the low-pressure outlet 37 flows from the low-pressure inlet 31 to the low-pressure outlet 37, and flows through the low-pressure outlet 37, without being compressed by means of the high-pressure fuel pump 10 in the process. As will be discussed in more detail below, it is conceivable for at least a part of the fuel at the second or third pressure flowing through the low-pressure outlet 37 to be conducted via the low-pressure outlet 37 to the second injection device 20, in particular to the fuel distribution element 24, such that the fuel at the second or third pressure is received and stored in the fuel distribution element 24.

The pump device 11 furthermore comprises a third low-pressure port 39 for conducting fuel conveyed by means of the low-pressure pump 28, in particular at the second or third pressure, to the second injection device 20. The low-pressure port 39 has a duct 41 through which the fuel may flow and which is fluidically connected to the low-pressure fuel pump 28. In this way, at least a part of the fuel conveyed by means of the low-pressure fuel pump 28 and at the second or third pressure is conducted via the low-pressure port 39 or the duct 41 to the second injection device 20, in particular to the fuel distribution element 24, and stored in the fuel distribution element 24, in particular at the second or third pressure.

Thus, the fuel at the third pressure or second pressure flows through the low-pressure port 39 or the duct 41. Altogether, it is evident that the fuel in the low-pressure inlet 31 and in the low-pressure outlet 37 and in the duct 41 is at the second pressure. In other words, the fuel flowing through the low-pressure inlet 31, the low-pressure outlet 37 and the duct 41 is at the second or third pressure which is effected by means of the low-pressure fuel pump 28, where a compression, effected by means of the high-pressure fuel pump 10, of the fuel flowing through the low-pressure inlet 31, the low-pressure outlet 37 and the duct 41 to a pressure higher than the second or third pressure is omitted.

The high-pressure fuel pump 10 has a low-pressure chamber 40 which may be flowed through by at least a part of the fuel fed to the high-pressure fuel pump 10 via the low-pressure inlet 31. The high-pressure fuel pump 10 furthermore comprises a first structural element in the form of a pump housing 42. Furthermore, the high-pressure fuel pump 10 has a conveying element for conveying at least a part of the fuel fed to the high-pressure fuel pump 10 via the low-pressure inlet 31, where the conveying element is in the present case formed as a piston 44. The piston 44 is also referred to as conveying piston, where the piston 44 has a first length region 46 and an adjoining second length region 48. The length region 46 has a first outer circumference, where the length region 48 has a second outer circumference which is shorter than the first outer circumference. Since the length regions have different outer circumferences, the piston 44 has a step. The piston 44 is thus formed as a stepped pin.

It is alternatively conceivable for the length regions 46 and 48 to have the same outer circumference, such that the piston 44 has no step.

The piston 44 is arranged at least partially in the pump housing 42, and in this case is movable relative to the pump housing 42, where the piston 44 is in the present case movable in translational fashion relative to the pump housing 42. The translational mobility of the piston 44 relative to the pump housing 42 is indicated in FIG. 1 by a double arrow 50. A compression chamber 52, illustrated in particularly schematic form in FIG. 1, of the high-pressure fuel pump 10 is arranged on a first side of the piston 44, where the compression chamber 52 is arranged for example in the pump housing 42. A volume of the compression chamber 52 is varied by translational movement of the piston 44 relative to the pump housing 42 and thus relative to the compression chamber 52.

The high-pressure fuel pump 10 furthermore comprises a second structural element for example in the form of a cover 54, which is formed separately from the pump housing 42 and which is connected to the pump housing 42 or held on the pump housing 42.

Furthermore, a drive element is provided in the form of a cam 56 which is illustrated particularly schematically in FIG. 1 and by means of which the piston 44 is movable relative to the pump housing 42, in the present case in the direction of the cover 54. Here, the high-pressure fuel pump 10 comprises at least one spring element which is not illustrated in FIG. 1 and which is placed under stress by movement of the piston 44 in the direction of the cover 54. By means of the spring element, the piston 44 is moved from the cover 54 back in the direction of the cam 56 and is in particular held in supported contact with the cam 56 by relaxation of the spring element.

Movement of the piston 44 in the direction of the cover 54 causes the volume of the compression chamber 52 to be decreased, whereby fuel accommodated in the compression chamber 52 is compressed, that is to say pressurized.

Movement of the piston 44 away from the cover 54 causes the volume of the compression chamber 52 to be increased, whereby fuel is drawn into the compression chamber 52. Here, it is provided in particular that the compression chamber 52 is fluidically connectable or connected to the low-pressure chamber 40, such that fuel may be or is drawn into the compression chamber 52 from the low-pressure chamber 40 by means of the piston 44.

The fuel that is drawn and thus flows from the low-pressure chamber 40 into the compression chamber 52 is at least a part of the fuel fed to the high-pressure fuel pump 10 or introduced into the high-pressure fuel pump 10 via the low-pressure inlet 31 (inflow), because at least a part of the fuel introduced via the inflow (low-pressure inlet 31) into the high-pressure fuel pump 10 may flow into the low-pressure chamber 40 and be drawn, or is drawn, from there into the compression chamber 52 by means of the piston 44.

As a result of the compression of the fuel by means of the piston 44, a fourth pressure of the fuel is effected or set by means of the high-pressure fuel pump 10, where the fourth pressure is higher than the second and the third pressure. For example, the fourth pressure corresponds to the first pressure, such that the first injection device 14, in particular the fuel distribution element 18, is supplied with the first pressure or fourth pressure by means of the high-pressure fuel pump 10.

It is seen from FIG. 7 that the high-pressure fuel pump 10 comprises a high-pressure port 58 (not illustrated in FIG. 1) via which the fuel compressed or pressurized by means of the piston 44 is fed from the compression chamber 52 to the first injection device 14, in particular to the fuel distribution element 18. This means that the first injection device 14, in particular the fuel distribution element 18, is fluidically connected to the high-pressure fuel pump 10 via the high-pressure port 58. Here, the fuel flows through the high-pressure port 58 at the fourth pressure or first pressure. In other words, the fuel in the high-pressure port 58 or the fuel flowing through the high-pressure port 58 is at the fourth pressure, which may correspond to the first pressure and which is significantly higher than the second and the third pressure.

FIG. 1 shows a dashed line which is used to illustrate a flow, through the high-pressure fuel pump 10, of at least a part of the fuel introduced into the high-pressure fuel pump 10 via the low-pressure inlet 31. From the dashed line, it is seen that at least a part of the fuel introduced via the low-pressure inlet 31 into the high-pressure fuel pump 10 flows through the high-pressure fuel pump 10 and, in the process, flows from the low-pressure inlet 31 to the low-pressure outlet 37 and flows through the low-pressure outlet 37. The part which is at the second or third pressure may flow out of the high-pressure fuel pump 10 via the low-pressure outlet, whereby the high-pressure fuel pump 10 may for example be cooled in an effective manner even if an injection of fuel effected by means of the first injection device 14 is omitted while, for example, fuel is drawn into and discharged from the compression chamber 52 by means of the piston 44.

FIG. 1 also shows a directional arrow 60 which illustrates a flow of the fuel through the duct 41 and thus through the low-pressure port 39 and from the latter to the second injection device 20, in particular to the fuel distribution element 24. Furthermore, directional arrows 61 illustrate a flow of the fuel flowing through the low-pressure outlet 37, where the flow will be discussed in more detail below.

Since each combustion chamber is assigned an injection valve 22 of the second injection device 20, multiple locations arranged upstream of the combustion chambers are provided at which fuel is injected by means of the second injection device 20. This type of induction pipe injection is also referred to as multi-port injection (MPI), such that the low-pressure port 39 is also referred to as MPI port.

Here, it is for example possible for at least one of the injection devices 14 and 20, in particular the first injection device 14, to be activated and deactivated according to demand. In the activated state of the injection device 14, the fuel is injected by means of the injection device 14 directly into the combustion chambers. In the deactivated state of the injection device 14, a direct injection of the fuel into the combustion chambers effected by means of the injection device 14 is omitted. Here, even in the deactivated state of the injection device 14, fuel conveyed by means of the low-pressure fuel pump 28, in particular at the second or third pressure, is fed to the high-pressure fuel pump 10 via the low-pressure inlet 31, where the fuel is thus at the third or second pressure, which is lower than the fourth or first pressure.

Since the fuel flowing through the low-pressure inlet 31 is not compressed by means of the high-pressure fuel pump 10 or has not yet been compressed by means of the high-pressure fuel pump 10, the fuel flowing through the inflow (low-pressure inlet 31) is at a low temperature, such that the high-pressure fuel pump 10, fuel flowing through the low-pressure inlet 31 and subsequently through the low-pressure outlet 37, is cooled, for example even when the injection device 14 is deactivated, by means of the fuel fed to the high-pressure fuel pump 10 via the low-pressure inlet 31 and flowing through the low-pressure outlet 37. For this purpose, at least a part of the fuel flowing through the low-pressure inlet 31 flows through the low-pressure outlet 37 and therefore not through the compression chamber 52, such that the high-pressure fuel pump 10 is cooled. This means that the fuel flowing through the low-pressure outlet 37 circumvents the compression chamber 52, that is to say does not flow through the compression chamber 52, or is not drawn into the compression chamber 52 by means of the piston 44.

On a side of the piston 44 averted from the compression chamber 52, a chamber 62 is provided which functions for example as a collecting chamber. The piston 44 is guided for example by means of a guide that is not shown in FIG. 1. Owing to leakages, fuel may flow out of the compression chamber 52 between the piston 44 and the guide, where the fuel is also referred to as leakage fuel. The leakage fuel flows into the chamber 62 and is thus collected by means of the chamber 62. It is preferably provided here that the chamber 62 is fluidically connected to the low-pressure chamber 40 by means of at least one connecting duct. The chamber 62 has a volume which is variable by movement of the piston 44 relative to the pump housing 42. If the piston is moved away from the cover 54 in particular by means of the spring element, whereby the volume of the compression chamber 52 is increased, the volume of the chamber 62 is decreased as a result. As a result, for example, fuel that is accommodated in the chamber 62 is conveyed out of the chamber 62 and is conveyed in particular via the stated fluidic connection into the low-pressure chamber 40.

If the piston 44 is moved in the direction of the cover 54 in particular by means of the cam 56, whereby the volume of the compression chamber 52 is decreased, the volume of the chamber 62 is increased. As a result, for example, fuel is drawn from the low-pressure chamber 40 into the chamber 62 via the stated fluidic connection. As already described above, at least a part of the fuel fed to the high-pressure fuel pump 10 via the low-pressure inlet 31 may flow into the low-pressure chamber 40, because the inflow, in particular the duct 32, is fluidically connected to the low-pressure chamber 40.

Fuel is thus conveyed back and forth between the chamber 62 and the low-pressure chamber 40 by movement of the piston 44. Furthermore, the low-pressure chamber 40 is for example fluidically connected to the low-pressure outlet 37, such that the fuel flowing through the low-pressure inlet 31 may flow via the low-pressure chamber 40, or through the latter, to the low-pressure outlet 37. In this way, heat is discharged from the high-pressure fuel pump 10, in particular from the piston 44, in a particularly advantageous manner, such that overheating and resulting damage of the high-pressure fuel pump 10 may be avoided.

As a result of fuel being drawn into the compression chamber 52 and/or into the chamber 62 and the fuel being conveyed out of the compression chamber 52 and/or out of the chamber 62, pulsations of the fuel may arise. It is conceivable here for a damping device to be arranged at least partially in the cover 54, by means of which damping device the stated pulsations of the fuel may be dampened. The cover 54 is thus for example also referred to as damper cover.

To now realize a particularly advantageous fluid supply in the form of a particularly advantageous supply of the fuel to the internal combustion engine, the pump device 11 comprises at least one mixing region 64 for mixing the fuel flowing through the low-pressure outlet 37 with fuel which is fed to the mixing region from the low-pressure fuel pump 28 upstream of the high-pressure fuel pump 10 and which is at the second or third pressure, where the low-pressure port 39 is fluidically connected to the mixing region 64, and where the low-pressure inlet 31 is supplied with fuel from the mixing region 64.

In other words, the mixing region 64 is fluidically connected to the low-pressure inlet 31 and fluidically connected to the low-pressure outlet 37. The mixing region 64 is assigned a low-pressure port 66, which has a duct 68 through which the fuel may flow. Furthermore, the mixing region 64 is assigned a low-pressure port 70, which has a duct 72 through which the fuel may flow. The ducts 32, 41, 68 and 72 are fluidically connected to the mixing region 64, where the ducts 68 and 72 open into the mixing region 64 and the ducts 32 and 41 branch off from the mixing region 64. In this way, it is for example possible for fuel to flow from the mixing region 64 into the duct 41, where fuel may flow from the mixing region 64 into the duct 32. Furthermore, the fuel flowing through the duct 68 may flow into the mixing region 64, where the fuel flowing through the duct 72 may also flow into the mixing region 64. Here, the duct 72 is arranged upstream of the mixing region 64, where the duct 68 is also arranged upstream of the mixing region 64.

From FIG. 1, it is seen on the basis of the directional arrows 61 that the low-pressure port 66 is fluidically connected to the low-pressure port 36, such that the ducts 38 and 68 are fluidically connected to one another. In this way, fuel at the second or third pressure flowing through the low-pressure outlet 37 and the duct 38 may also flow through the duct 68, such that the fuel flowing through the duct 68 is at the second or third pressure. The directional arrows 61 thus illustrate a flow direction along which the fuel flows through the duct 38 or the duct 68.

The mixing region 64 is fluidically connected by means of the low-pressure port 70, in particular the duct 72, to the low-pressure fuel pump 28, such that the fuel conveyed by means of the low-pressure fuel pump 28 and thus at the second or third pressure is fed to the mixing region 64 via the duct 72 or the low-pressure port 70. The fuel flowing through the duct 72 is therefore at the second or third pressure effected by means of the low-pressure fuel pump 28. Furthermore, the fuel flowing through the duct 41 is at the second or third pressure because a compression, effected by means of the high-pressure fuel pump 10, of the fuel flowing through the duct 41 is omitted. The second injection device 20 may therefore be supplied with the fuel at the second or third pressure via the MPI port.

Since the duct 72 is arranged upstream of the high-pressure fuel pump 10, the fuel flowing through the duct 72 has not been compressed by means of the high-pressure fuel pump 10, such that the fuel flowing through the duct 72 is at a low temperature. The fuel flowing through the duct 72 is also referred to as fresh fuel. By contrast to this fresh fuel, the fuel flowing through the low-pressure outlet 37 and thus the duct 38 is at a higher temperature than the fuel flowing through the duct 72, because the fuel flowing through the duct 38 flows through the high-pressure fuel pump 10 and thus cools the latter, such that heat is transferred from the high-pressure fuel pump 10 to the fuel flowing through the duct 38. The fuel flowing through the duct 38 is therefore a hot medium, which is also referred to as purging medium or cooling medium. Since both the fresh fuel and the purging medium are fed to the mixing region 64, the fresh fuel may mix with the purging medium, such that excessive temperatures of the fuel may be avoided. Furthermore, a particularly advantageous dissipation of heat may be realized, such that the high-pressure fuel pump 10 is cooled in a particularly effective manner. As a result, a reliable supply of fuel to the internal combustion engine may be realized.

It is seen from the dashed line that the fuel flowing from the low-pressure inlet 31 to the low-pressure outlet 37 and flowing through the low-pressure outlet 37 flows through the chamber 62, and in so doing circumvents, that is to say does not flow through, the compression chamber 52. In this way, heat is dissipated from the region of the chamber 62 in a particularly effective manner. The region is for example a drive region, in which high levels of heat generation may occur. Since the fuel flows through the drive region, a large quantity of heat is dissipated from the drive region, such that the high-pressure fuel pump 10 is cooled.

The MPI port is therefore not supplied with fuel directly from the low-pressure outlet 37, it rather being the case that the mixing region 64 is connected between the low-pressure outlet 37 and the MPI port, where the MPI port may be or is supplied with fuel from the mixing region 64.

It is seen particularly clearly from FIG. 1 that the low-pressure ports 39, 66 and 70 form a triple port, where the low-pressure ports 30, 39, 66 and 70 in which the fuel is at the second or third pressure are in the present case arranged on one of the structural elements, in the present case on the cover 54. It is alternatively conceivable for the low-pressure ports 30, 39, 66 and 70 to be arranged on the pump housing 42. It is conceivable here for the low-pressure ports 30, 39, 66 and 70 to be formed in one piece with one another. It is furthermore conceivable for the low-pressure ports 30, 39, 66 and 70 to be formed by components which are formed separately from one another and which are connected to one another. It is furthermore possible for at least one of the low-pressure ports 30, 39, 66 and 70 to be formed in one piece with the one structural element, in particular the cover 54, on which the low-pressure ports 30, 39, 66 and 70 are held. It is furthermore possible for at least one of the low-pressure ports 30, 39, 66 and 70 to be formed as a component which is formed separately from the one structural element and which is held on the one structural element. It is furthermore conceivable for at least one of the low-pressure ports 30, 39, 66 and 70 or all of the low-pressure ports 30, 39, 66 and 70 to be arranged on the pump housing 42, where the embodiments of the low-pressure ports 30, 39, 66 and 70 discussed above with regard to the cover 54 may readily also be transferred to the pump housing 42 and vice versa. In particular, it is possible for the low-pressure ports 30, 39, 66 and 70 to be interchanged, such that for example the sequence of the inflow, the MPI port and the cooling medium is interchanged or configured differently.

It may also be seen from FIG. 1 that, in the present case, the low-pressure port 36 is arranged on the pump housing 42. As an alternative to this, it is conceivable for the low-pressure port 36 to be arranged on the cover 54. In other words, the low-pressure port 36 is arranged on one of the structural elements. Here, the low-pressure port 36 may be formed in one piece with the one structural element. It is alternatively conceivable for the low-pressure port 36 to be formed as a component which is formed separately from the one structural element and which is held on the one structural element. The embodiment of the low-pressure port 36 may readily also be transferred to the other low-pressure ports 30, 39, 66 and 70.

FIG. 1 illustrates a directional arrow 74. The directional arrow 74 illustrates the supply of the fuel at the second or third pressure conveyed by means of the low-pressure fuel pump 28 to the duct 72. In other words, the directional arrow 74 illustrates a flow direction along which the fuel conveyed by means of the low-pressure fuel pump 28 flows into and through the duct 72. The directional arrows 34, 60, 61 and 74 thus illustrate respective flow directions of the fuel through the ducts 32, 41, 68 and 72. The flow directions of the fuel through the ducts 32 and 72 in this case run at least substantially parallel to one another, and in the present case coincide, where the flow directions of the fuel through the ducts 41 and 68 run at least substantially parallel to one another, and in the present case coincide. Here, the flow directions of the fuel through the ducts 32 and 72 run at least substantially perpendicular to the flow directions of the fuel through the ducts 41 and 68.

In particular, it is provided that the low-pressure port 39 is supplied with fuel from the mixing region 64. Here, it is conceivable that the low-pressure port 39 is designed to conduct at least a part of the fuel conveyed by means of the low-pressure fuel pump 28 and fed to the high-pressure fuel pump 10 and flowing through the low-pressure outlet 37 away from the high-pressure fuel pump 10, in particular from the pump device 11, to the second injection device 20, such that, for example, at least a part of the fuel flowing through the duct 41 is at least a part of the fuel flowing through the low-pressure outlet 37. Furthermore, in the first embodiment, it is provided that the ducts 32, 41, 68 and 72 are arranged in an at least substantially cross-shaped manner.

The mixing region 64 has at least one first feed opening 76, by means of which the mixing region 64 is fluidically connected to the low-pressure outlet 37 and may thus be supplied with the fuel flowing through the low-pressure outlet 37. Therefore, the duct 68 or the low-pressure port 66 is a return line from the high-pressure fuel pump 10. The mixing region 64 furthermore has a second feed opening 78, by means of which the mixing region 64 is supplied, upstream of the high-pressure fuel pump 10, with fuel from the duct 72 and thus from the low-pressure fuel pump 28 or the tank 26. This means that the above-described fresh fuel may flow via the second feed opening 78 into the mixing region 64, where the fuel flowing through the low-pressure outlet 37 may flow into the mixing region 64 via the first feed opening 76.

The mixing region 64 furthermore comprises a first discharge opening 80, via which the fuel is fed from the mixing region 64 into the low-pressure inlet 31. This means that the mixing region 64 is fluidically connected by means of the first discharge opening 80 to the low-pressure inlet 31. Finally, the mixing region 64 has a second discharge opening 82, by means of which the low-pressure port 39, in particular the duct 41, is fluidically connected to the mixing region 64, such that, for example, fuel is fed from the mixing region 64 via the second discharge opening 82 to the low-pressure port 39, in particular to the duct 41. In the present case, the feed opening 78 and the discharge opening 80 are arranged in respective first planes which run at least substantially parallel to one another. Furthermore, the feed opening 76 and the discharge opening 82 are arranged in respective second planes which run at least substantially parallel to one another and which run at least substantially perpendicular to the first planes.

Figure 2:
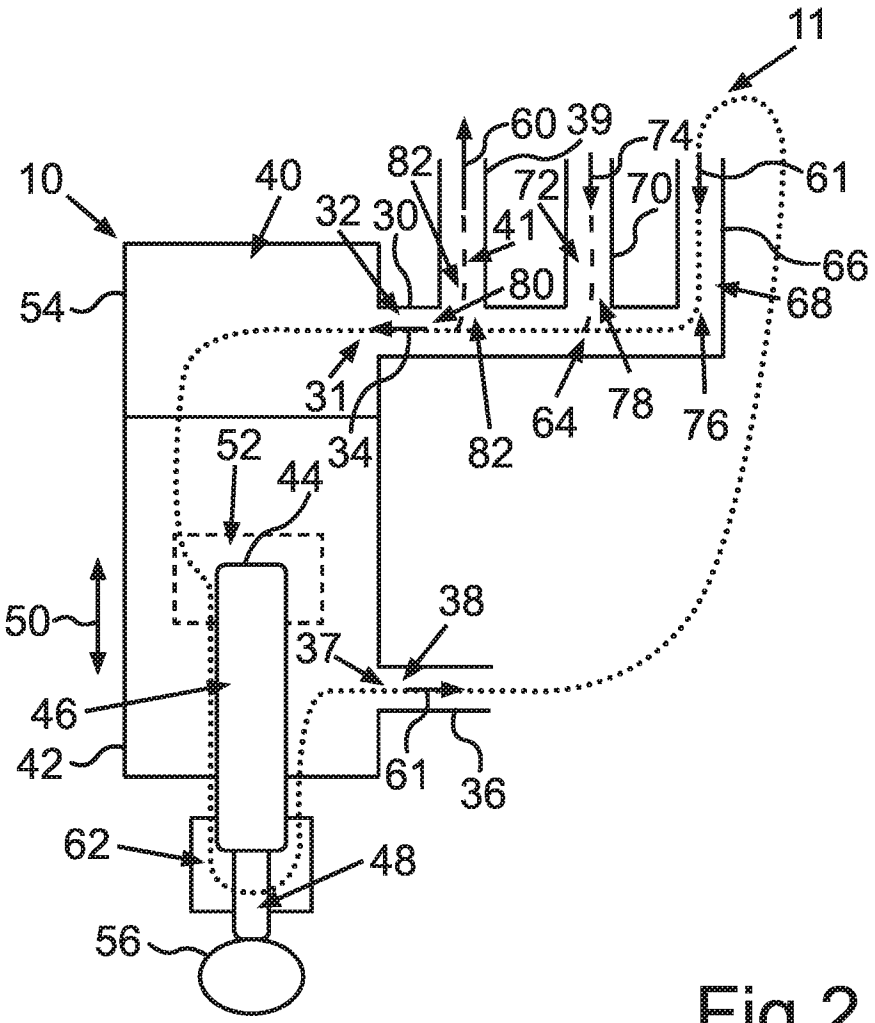
FIG. 2 shows a schematic sectional view of the pump device according to a second embodiment.

FIG. 2 shows a second embodiment of the pump device 11. In the second embodiment, the low-pressure ports 39, 66 and 70 are arranged sequentially with respect to one another, where the second discharge opening 82 is arranged upstream of the first discharge opening 80, downstream of the second feed opening 78 and downstream of the first feed opening 76 in relation to a flow direction of the fuel from the second feed opening 78 to the first discharge opening 80. Furthermore, the first feed opening 76 is arranged upstream of the second discharge opening 82 and upstream of the second feed opening 78 and also upstream of the first discharge opening 80 in relation to the flow direction of the fuel from the second feed opening 78 to the first discharge opening 80. In the present case, the flow directions of the fuel through the ducts 41, 72 and 68 as illustrated by means of the directional arrows 60, 61 and 74 run at least substantially parallel to one another, where the flow directions may also run obliquely or perpendicular with respect to one another. Furthermore, it is also the case in the second embodiment that a triple port is formed, which in the present case is arranged on one of the structural elements, and in the present case on the cover 54. As an alternative to this, it is conceivable for the triple port to be arranged on the pump housing 42.

Figure 3:
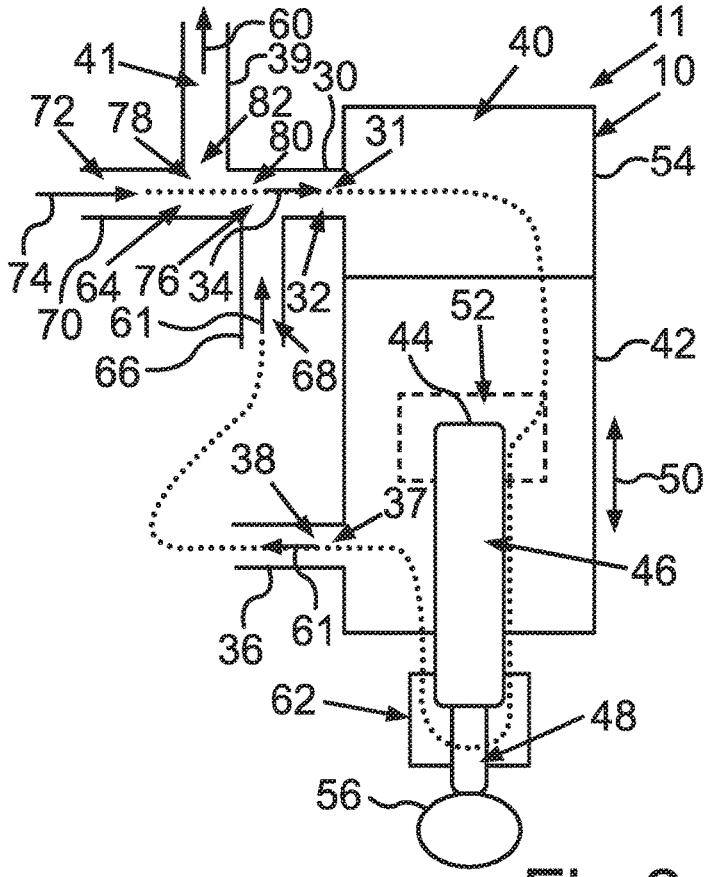
FIG. 3 shows a schematic sectional view of the pump device according to a third embodiment.

FIG. 3 shows a third embodiment of the pump device 11. The third embodiment differs from the first embodiment in particular in that the flow directions of the fuel through the low-pressure ports 39 and 66 or through the ducts 41 and 68 as illustrated by means of the directional arrows 60 and 61, despite being at least substantially parallel, do not coincide but rather are spaced apart from one another. Here, the feed opening 76 has a first partial region and the discharge opening 82 has at least one second partial region, where the partial regions may be arranged so as not overlap one another.

In the third embodiment, it is provided that the second discharge opening 82 is arranged upstream of the first feed opening 76 in relation to a flow direction of the fuel from the second feed opening 78 to the first discharge opening 80, where the cooling medium is introduced via the first feed opening 76 into the mixing region and the fresh fuel is introduced via the second feed opening 78 into the mixing region 64, and where fuel is fed from the mixing region 64 via the discharge opening 80 to the low-pressure inlet 31 and via the discharge opening 82 to the duct 41 or to the fuel distribution element 24. This means that the MPI port (low-pressure port 39) branches off a short distance upstream of the feed opening 76 that constitutes an inflow for the hot cooling medium into the mixing region 64, such that the hot medium flowing in via the duct 68 and the mixing region 64, in the form of the hot fuel, is not conducted directly to the MPI port or to the fuel distributor 24.

Figure 4:
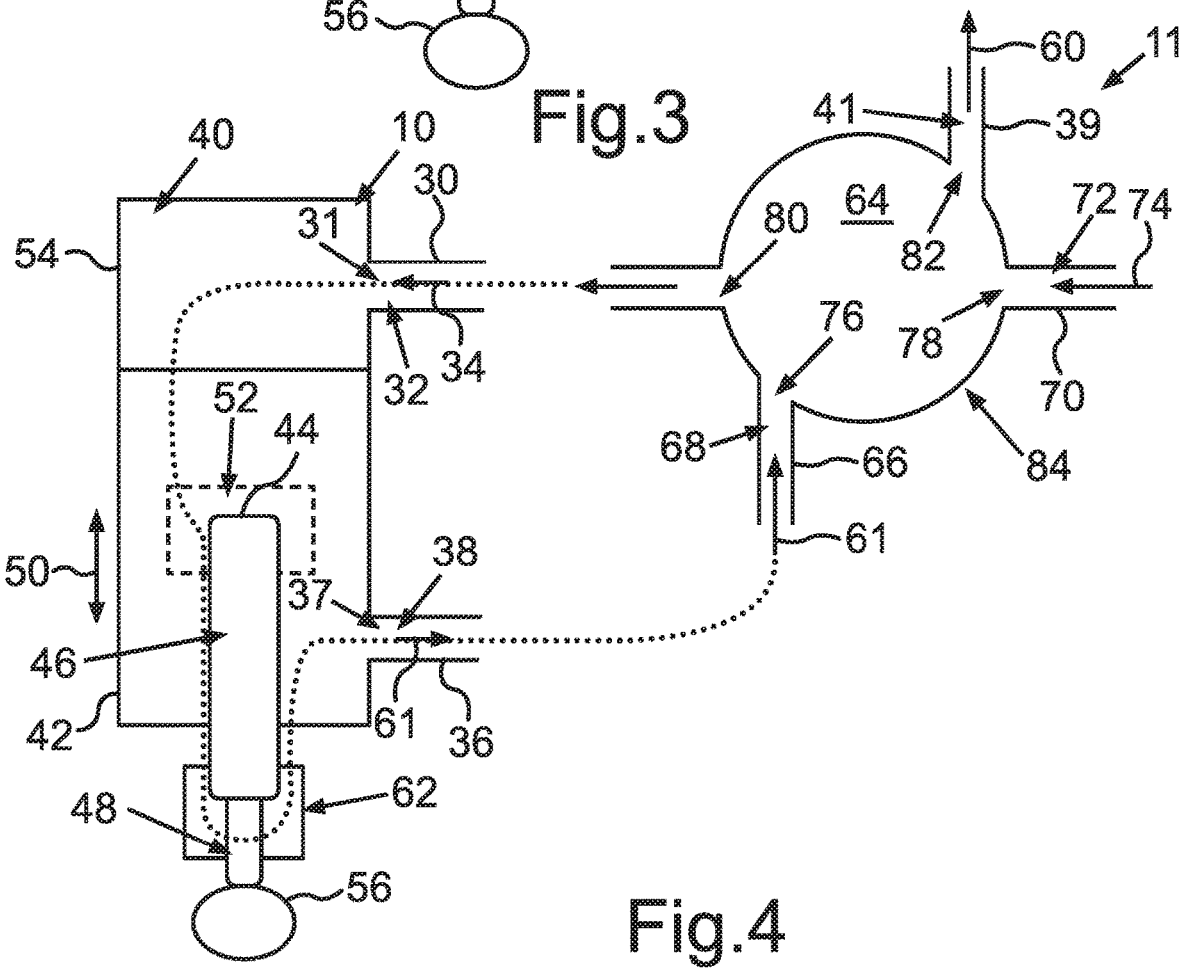
FIG. 4 shows a schematic sectional view of the pump device according to a fourth embodiment.

FIG. 4 shows a fourth embodiment of the pump device 11. It is seen particularly clearly from FIG. 4 that the mixing region 64 is formed for example by a mixing device 84 of the pump device 11, where the mixing device 84 may be formed in one piece with one of the structural elements (cover 54 and pump housing 42). It is alternatively conceivable for the mixing device 84 to be formed as a component which is formed separately from the structural elements and which is arranged or held on one of the structural elements. The mixing region 64 may be formed for example by a separate vessel.

In the first, second and third embodiments, the mixing region 64 has an at least substantially rectangular inner circumference. In the fourth embodiment, it is provided that the mixing region is at least partially, in particular at least predominantly, of spherical or spherical-segment-shaped form on the inner circumference, where the mixing region 64 has a large volume. In particular, in the mixing region 64, an enlarged volume is provided in relation to the ducts 32, 41, 68 and 72. The fuel flowing into the mixing region 64 via the ducts 68 and 72 mixes in particular owing to its respective flow and owing to the shape or inner circumferential shape of the mixing region 64.

The fuel is a fluid, in particular a liquid fluid, where the fuel flowing through the duct 68 constitutes for example a first flow, in particular a first fluid flow, where the fuel flowing through the duct 72 constitutes for example a second flow, in particular a second fluid flow. The fluid flows are introduced into the mixing region 64 or fed to the mixing region 64 via the feed openings 76 and 78, such that the feed openings 76 and 78 constitute inlets of the mixing region 64. The fluid flows may mix in the mixing region 64.

Fluid, that is to say mixed fuel, is discharged from the mixing region 64 via the discharge openings 80 and 82, such that the discharge openings 80 and 82 constitute outlets of the mixing region 64. As an alternative to the spherical form of the mixing region 64 on the inner circumference as shown in FIG. 4, a cylindrical form is possible, such that, on the inner circumference, the mixing region 64 has for example the shape of an at least substantially straight cylinder. The principle of the mixing region 64 with regard to the mixing of the fuel may also be transferred to other media or fluids or utilized for other media in order to mix the media or fluids. The use of a greater or smaller number of ports, that is to say inlets and outlets, is also conceivable.

Figure 5A:
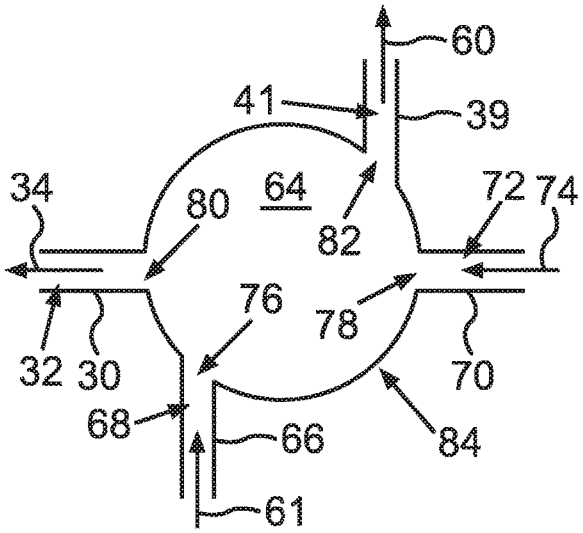
FIGS. 5*a-p* show respective schematic sectional views of different embodiments of the mixing region.
Figure 5B:
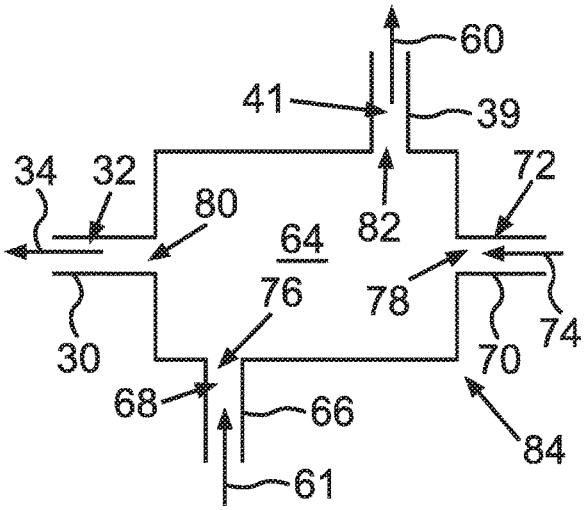
Figure 5C:
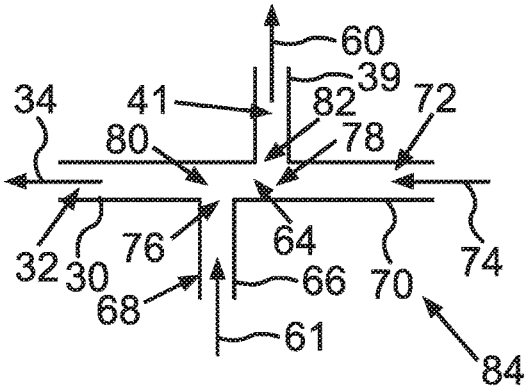
Figure 5D:
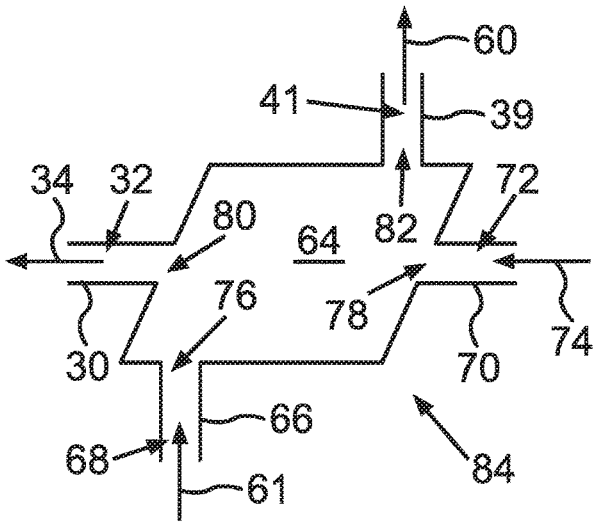

FIG. 5*a* shows a first embodiment of the mixing device 84, where the first embodiment of the mixing device 84 is used for example in the case of the fourth embodiment of the pump device. FIG. 5*b* shows a second embodiment of the mixing device 84. In the case of this second embodiment, the mixing region 64 is of cuboidal form on the inner circumference, or at least partially has an at least substantially rectangular cross section. FIG. 5*c* shows a third embodiment of the mixing device 84, where the third embodiment is used for example in the case of the third embodiment of the pump device 11. FIG. 5*d* shows a fourth embodiment of the mixing device 84. The fourth embodiment of the mixing device 84 basically corresponds to the second embodiment of the mixing device 84, but with the difference that the mixing region 64 is at least partially of parallelogram-shaped or trapezoidal form on the inner circumference, such that the mixing region 64 has for example the shape of an oblique prism on the inner circumference.

Figure 5E:
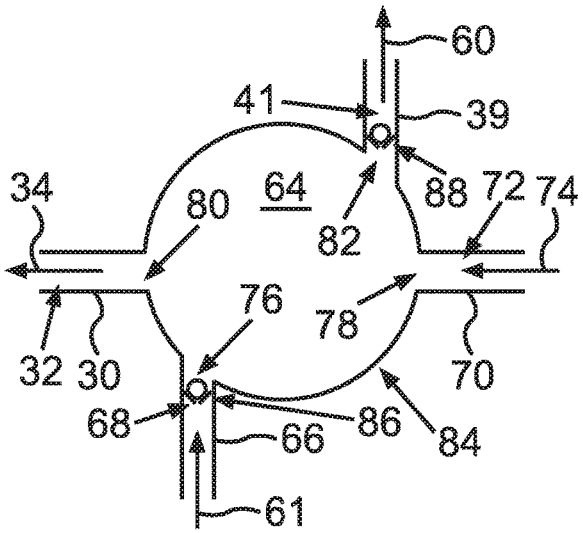

FIG. 5*e* shows a fifth embodiment of the mixing device 84. It may be seen that the feed opening 76 (first inlet) opens into the duct 68 or vice versa. Furthermore, the second feed opening 78 opens into the duct 72 or vice versa. The discharge opening 80 opens into the duct 32 or vice versa, where the discharge opening 82 opens into the duct 41 or vice versa. In the fifth embodiment, it is now the case that a valve element in the form of a check valve 86 is arranged in the duct 68, which valve element opens with regard to a flow direction of the fuel toward the mixing region 64 and thus permits a flow of fuel in the direction of the mixing region 64 and prevents a flow of the fuel in an opposite direction, such that the fuel may flow from the ducts 68 into the mixing region 64. However, no fuel may flow from the mixing region 64 into the duct 68. Furthermore, a valve element in the form of a check valve 88 is arranged in the duct 41, where the check valve 88 blocks in the direction of the mixing region 64 and opens in the opposite direction. In this way, fluid or fuel may flow from the mixing region 64 into the duct 41, but no fuel may flow from the duct 41 back into the mixing region 64.

Figure 5F:
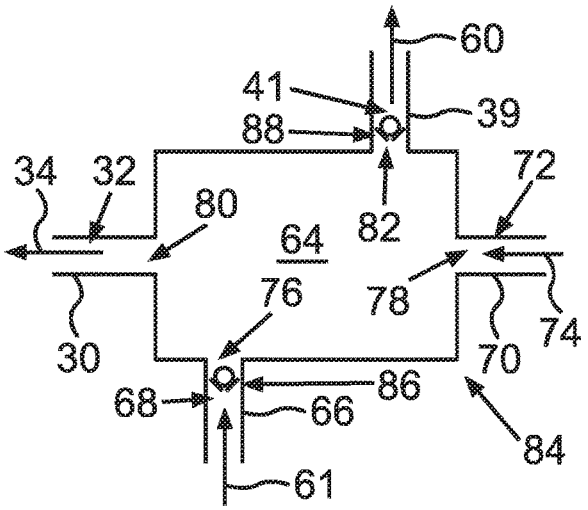

FIG. 5*f* shows a sixth embodiment of the mixing device 84, where the sixth embodiment basically constitutes a combination of the second embodiment with the fifth embodiment. In the sixth embodiment, the mixing region 64 is at least substantially of cuboidal form on the inner circumference, where the check valves 86 and 88 are arranged in the ducts 68 and 41.

Figure 5G:
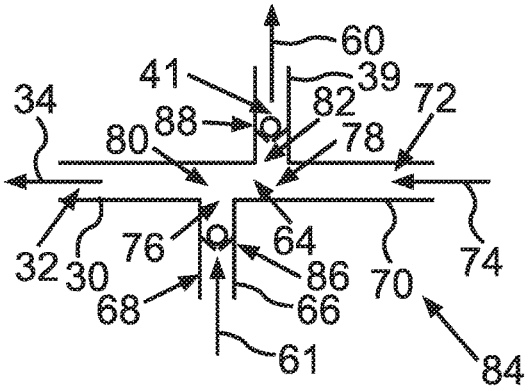
Figure 5H:
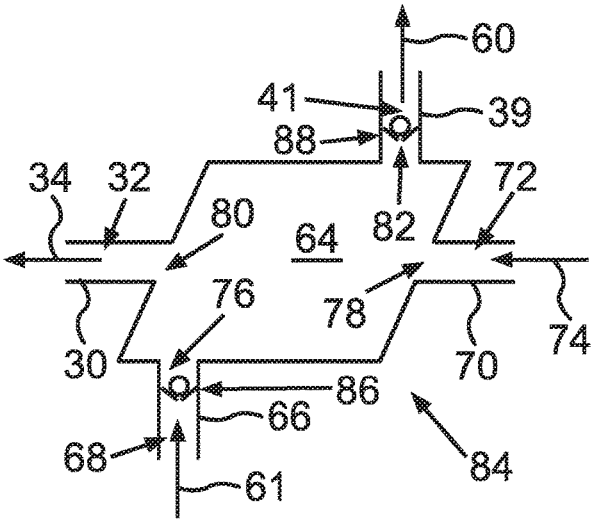

FIG. 5*g* shows a seventh embodiment, which basically constitutes a combination of the third embodiment with the fifth embodiment. Furthermore, FIG. 5*h* shows an eighth embodiment of the mixing device 84, where the eighth embodiment of the mixing device 84 basically constitutes a combination of the fourth embodiment with the fifth embodiment.

Figure 5I:
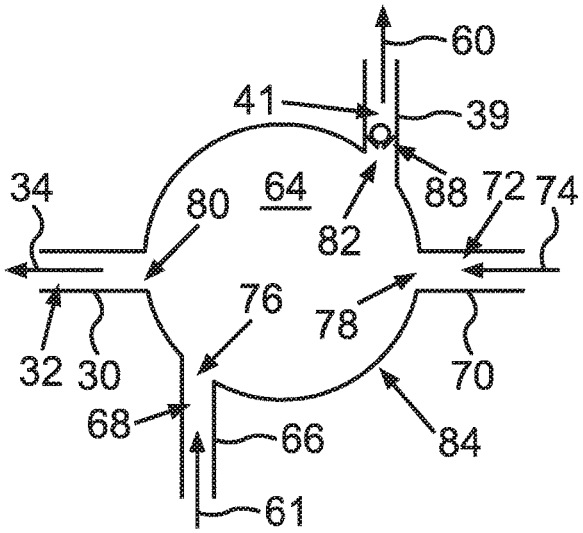

FIG. 5*i* shows a ninth embodiment of the mixing device 84. The ninth embodiment is in principle based on the first embodiment, where it is now the case that a check valve 88 is provided in the duct 41, as in the fifth embodiment. However, by contrast to the fifth embodiment, no check valve is arranged in the duct 68. In the ninth embodiment, it is provided only that the check valve 88 is arranged in the duct 41.

Figure 5J:
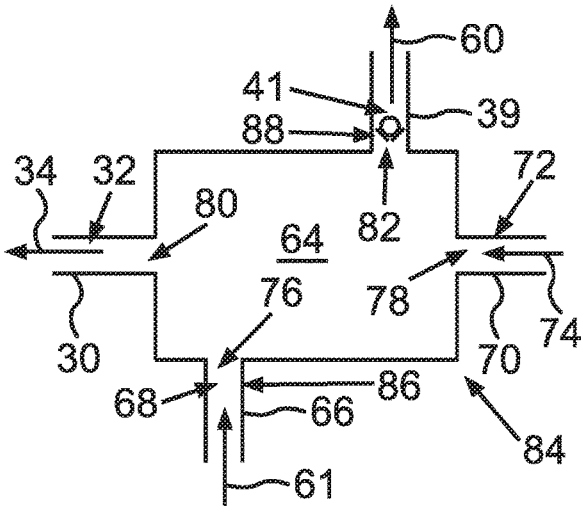
Figure 5K:
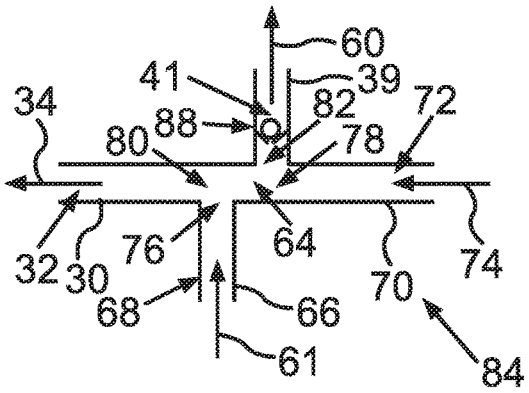
Figure 5L:
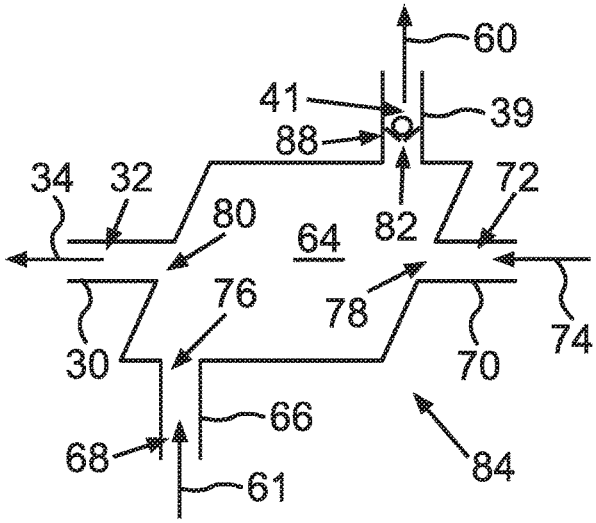

FIG. 5*j* shows a tenth embodiment of the mixing device 84, where the tenth embodiment basically constitutes a combination of the second embodiment with the ninth embodiment. FIG. 5*k* shows an eleventh embodiment of the mixing device 84, where the eleventh embodiment basically constitutes a combination of the third embodiment with the ninth embodiment of the mixing device 84. Furthermore, FIG. 5*l* shows a twelfth embodiment of the mixing device 84, where the twelfth embodiment basically constitutes a combination of the fourth embodiment with the ninth embodiment of the mixing device 84.

Figure 5M:
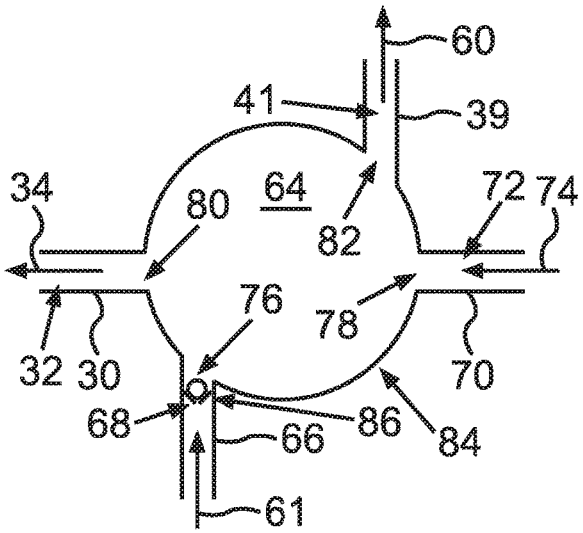

FIG. 5*m* shows a thirteenth embodiment of the mixing device 84. The thirteenth embodiment basically corresponds to the first embodiment, where it is now the case that a check valve 86 is arranged in the duct 68. By contrast to the fifth embodiment, no check valve is arranged in the duct 41, and it is thus provided only that the check valve 86 is arranged in the duct 68.

Figure 5N:
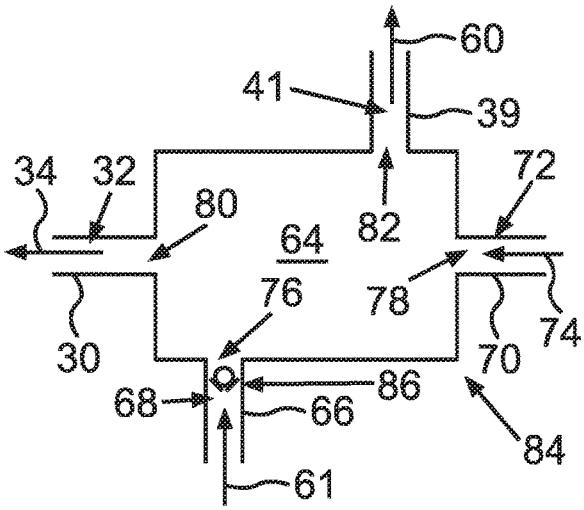
Figure 5O:
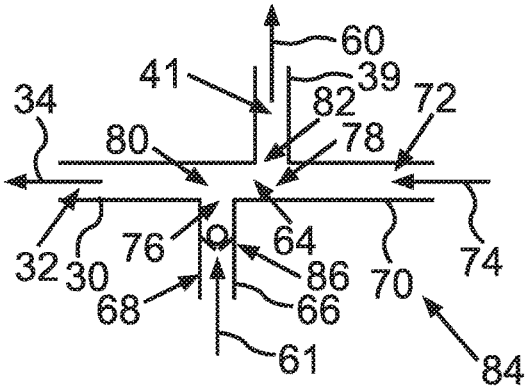
Figure 5P:
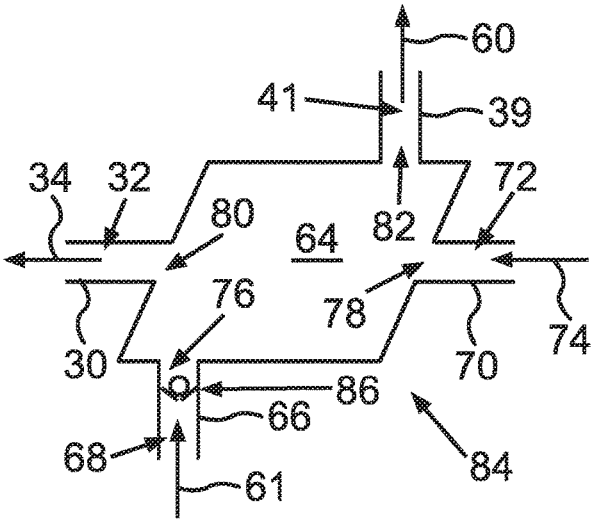

FIG. 5*n* shows a fourteenth embodiment of the mixing device 84, where the fourteenth embodiment basically constitutes a combination of the second embodiment with the thirteenth embodiment. FIG. 5*o* shows a fifteenth embodiment of the mixing device 84, where the fifteenth embodiment basically constitutes a combination of the third embodiment with the thirteenth embodiment. Finally, FIG. 5*p* shows a sixteenth embodiment of the mixing device 84, where the sixteenth embodiment basically constitutes a combination of the fourth embodiment and the thirteenth embodiment.

Figure 6A:
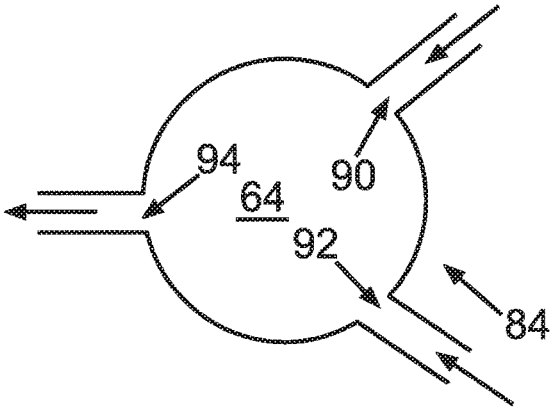
FIGS. 6*a,b* show respective schematic sectional views of further embodiments of the mixing region.
Figure 6B:
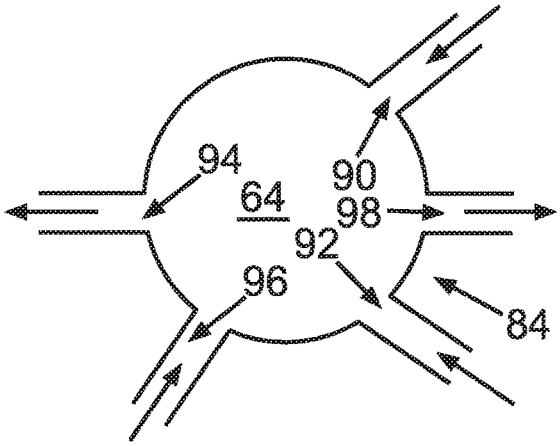

FIG. 6*a* shows a seventeenth embodiment of the mixing device 84. In the seventeenth embodiment, the mixing region 64 is of at least substantially spherical form on the inner circumference, where, in the present case, exactly two inflows 90 and 92 are provided, via which the fluid flows may be fed to the mixing region 64. Furthermore, in the seventeenth embodiment, the mixing region 64 has exactly one outlet 94, via which fluid is discharged from the mixing region 64. Finally, FIG. 6*b* shows an eighteenth embodiment of the mixing device 84. In the eighteenth embodiment, exactly three inlets 90, 92 and 96 are provided, via which respective fluid flows may be fed to the mixing region 64, which in the present case is at least substantially of spherical form. The present at least three fluid flows may mix in the mixing region 64, where, in the eighteenth embodiment, the mixing region has exactly two outlets 94 and 98 via which fluid is discharged from the mixing region 64. FIGS. 6*a* and 6*b* illustrate the principle or the function of the mixing region 64, the function of which consists in particular in mixing the fluid flows fed to the mixing region 64.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A pump device for an internal combustion engine, in particular of a motor vehicle, comprising:

a first injection device being part of the internal combustion engine;

a second injection device being part of the internal combustion engine;

a high-pressure fuel pump for supplying fuel to a first injection device;

a low-pressure fuel pump fluidically connected to the high-pressure fuel pump;

at least one low-pressure outlet being part of the high-pressure fuel pump;

at least one low-pressure inlet being part of the high-pressure fuel pump, via which the fuel is fed to the high-pressure fuel pump from the low-pressure fuel pump, and the at least one low-pressure outlet for conducting the fuel conveyed by means of the low-pressure fuel pump and fed via the low-pressure inlet to the high-pressure fuel pump out of the high-pressure fuel pump;

at least one low-pressure port being part of the high-pressure fuel pump, the at least one low-pressure port for conducting fuel conveyed by means of the low-pressure fuel pump to the second injection device;

at least one mixing region for mixing the fuel flowing through the low-pressure outlet with fuel fed to the mixing region from the low-pressure fuel pump upstream of the high-pressure fuel pump, the mixing region being located outside of the high-pressure fuel pump;

wherein the low-pressure port is fluidically connected to the mixing region, and the low-pressure inlet is supplied with fuel from the mixing region.

2. The pump device claim 1, wherein the low-pressure port is supplied with fuel from the mixing region.

3. The pump device of claim 2, the high-pressure fuel pump further comprising:

a conveying element, for conveying the fuel to the first injection device;

a compression chamber, the volume of which is variable by movement of the conveying element; and a collecting chamber, which is arranged on a side of the conveying element averted from the compression chamber and which is variable in terms of its volume by movement of the conveying element and which serves for collecting fuel from the compression chamber;

wherein at least a part of the fuel flowing through the low-pressure inlet flows from the low-pressure inlet to the collecting chamber, circumventing the compression chamber, flows through the collecting chamber and then flows through the low-pressure outlet and into the mixing region.

4. The pump device of claim 2, the mixing region further comprising:

at least one first feed opening, by means of which the mixing region is fluidically connected to the low-pressure outlet and is supplied with the fuel flowing through the low-pressure outlet;

at least one second feed opening, by means of which the mixing region is supplied, upstream of the high-pressure fuel pump, with fuel from the low-pressure fuel pump;

at least one first discharge opening, via which fuel is fed from the mixing region to the low-pressure inlet; and at least one second discharge opening, by means of which the low-pressure port is fluidically connected to the mixing region.

5. The pump device of claim 4, wherein the second discharge opening is arranged upstream of the first feed opening in relation to a flow direction of the fuel from the second feed opening to the first discharge opening.

6. The pump device of claim 4, wherein the second discharge opening is arranged upstream of the first discharge opening, downstream of the second feed opening and downstream of the first feed opening in relation to a flow direction of the fuel from the second feed opening to the first discharge opening.

7. The pump device of claim 6, wherein the first feed opening is arranged upstream of the second discharge opening and upstream of the second feed opening in relation to the flow direction of the fuel from the second feed opening to the first discharge opening.

8. The pump device of claim 4, further comprising a valve element, wherein at least one of the feed openings or at least one of the discharge openings opens into a duct through which the fuel may flow, and in which the valve element is arranged.

9. The pump device of claim 8, the valve element further comprising a check valve.

10. The pump device of claim 1, wherein the at least one mixing region is at least partially of spherical form on the inner circumference.

11. The pump device of claim 1, wherein the at least one mixing region is at least predominantly of spherical form on the inner circumference.

12. The pump device of claim 1, wherein the mixing region has a parallelogram-shaped cross section.

13. The pump device of claim 1, wherein the mixing region has a rectangular-shaped cross section.

14. The pump device of claim 1 wherein the low-pressure port is designed to conduct at least a part of the fuel conveyed by means of the low-pressure fuel pump and fed to the high-pressure fuel pump via the low-pressure inlet and flowing through the low-pressure outlet away from the pump device to the second injection device.

15. A fuel supply device for supplying fuel to an internal combustion engine, in particular of a motor vehicle, comprising:

a first injection device for effecting a direct injection of fuel;

a second injection device which is provided in addition to the first injection device and which serves for effecting an induction pipe injection of fuel;

a pump device comprising:

a high-pressure fuel pump for supplying the fuel to the first injection device;

a low-pressure fuel pump, for conveying the fuel to the high-pressure fuel pump;

at least one low-pressure inlet, via which fuel is fed to the high-pressure fuel pump from the low-pressure fuel pump;

at least one low-pressure outlet, for conducting fuel conveyed by means of the low-pressure fuel pump and fed via the low-pressure inlet to the high-pressure fuel pump out of the high-pressure fuel pump;

at least one low-pressure port, for conducting fuel conveyed by means of the low-pressure fuel pump to the second injection device;

at least one mixing region is provided for mixing the fuel flowing through the low-pressure outlet with fuel fed to the mixing region from the low-pressure fuel pump upstream of the high-pressure fuel pump, the mixing region being located outside of the high-pressure fuel pump;

wherein the low-pressure port is fluidically connected to the mixing region, and the low-pressure inlet is supplied with fuel from the mixing region.

16. A mixing device, in particular for a motor vehicle, having at least one mixing region for mixing at least one first fluid flow with at least one second fluid flow;

at least one first inlet, via which the first fluid flow is fed to the mixing region;

at least one second inlet, via which the second fluid flow is fed to the mixing region;

at least one first outlet for discharging fluid from the mixing region; and at least one second outlet for discharging fluid from the mixing region;

wherein the second outlet is arranged upstream of the first inlet in relation to a flow direction of the fluid from the second inlet to the first outlet, and the mixing region is located outside of a high-pressure fuel pump.

17. The mixing device of claim 16, wherein the mixing region has at least one of a rectangular-shaped cross-section, a parallelogram-shaped cross-section, an arcuate-shaped cross-section, or a circular-shaped cross-section, in at least one subregion on the inner circumference.

* * * * *